US005364050A

United States Patent [19]

Smith

[11] Patent Number: 5,364,050

[45] Date of Patent: Nov. 15, 1994

[54] HANGER FOR LATTICE

[76] Inventor: Harold C. Smith, 1101 Birchcrest Rd., Bellevue, Nebr. 68005

[21] Appl. No.: 158,951

[22] Filed: Nov. 29, 1993

[51] Int. Cl.[5] ..... A47B 96/06

[52] U.S. Cl. ..... 248/227; 248/304; 256/1

[58] Field of Search ..... 248/220.2, 220.3, 225.31, 248/227, 300, 301, 224.1, 304, 309.1, 339; 256/65, 66, 67, 68, 1

[56] References Cited

U.S. PATENT DOCUMENTS

| | | | |
|---|---|---|---|
| 1,357,893 | 11/1920 | Northrop | 248/300 |
| 1,375,509 | 4/1921 | Heatlie | 248/300 |
| 1,629,576 | 5/1927 | Irish . | |
| 1,676,915 | 7/1928 | Schulzke | 248/248 X |
| 1,873,297 | 8/1932 | Davenport | 248/220.3 X |
| 2,636,298 | 4/1953 | Macklanburg | 248/227 |
| 2,810,598 | 10/1957 | Lief | 211/123 X |
| 3,728,802 | 4/1973 | James | 211/123 X |
| 3,912,212 | 10/1975 | Betts, Sr. | 248/220.3 |
| 3,972,499 | 8/1976 | Simmons | 248/224 |
| 4,099,299 | 7/1978 | Bruggert et al. | 24/73 |
| 4,145,840 | 3/1979 | Davidson | 47/44 |
| 4,315,615 | 2/1982 | Scocozza | 248/220.2 X |
| 4,666,115 | 5/1987 | Schiro | 248/225.1 |
| 4,842,230 | 6/1989 | Cobb et al. | 248/304 X |
| 4,858,863 | 8/1989 | Lin | 248/174 |
| 4,860,905 | 8/1989 | Schott et al. | 248/220.3 X |
| 4,953,817 | 9/1990 | Mosteller | 248/222.2 |
| 5,181,683 | 1/1993 | Smith | 248/227 |

*Primary Examiner*—Ramon O. Ramirez
*Assistant Examiner*—Korie H. Chan
*Attorney, Agent, or Firm*—Zarley, McKee, Thomte, Voorhees & Sease

[57] ABSTRACT

A hanger includes a bracket with forward and rearward panels, and a connecting panel connecting the upper ends of the forward and rearward panels, to support bracket on a lattice. The connecting panel of the bracket has a generally V-shape lower surface which closely fits the upper surface of a strap intersection on the lattice, formed by the upper longitudinal edges of a pair of forward and rearward straps. A support arm mounted on the forward panel includes a horizontal arm projecting forwardly therefrom with a hook for suspending an object from the lattice. In one embodiment of the invention, a rod is mounted on the rearward panel and extends upwardly therefrom to engage a second strap intersection above the strap intersection upon which the bracket is mounted. In a second embodiment of the invention, the bracket is locked in position on the strap intersection by connecting the lower ends of the forward and rearward panels below the strap intersection.

9 Claims, 3 Drawing Sheets

HANGER FOR LATTICE

TECHNICAL FIELD

The present invention relates generally to hangers and hooks for plants and bird feeders and the like, and more particularly to a hanger specially designed to securely fasten objects to lattice.

BACKGROUND OF THE INVENTION

A wide variety of plant hangers and hooks for bird feeders are known to exist in the prior art. However, hooks are typically fastened directly into the soffit of an overhanging roof, with bird feeders or plant pots suspended from a wire attached to the hook.

While the location of such a hook orients the bird feeder in a desirable location, the conventional methods for fastening such hooks to the house have several drawbacks. Typically, it is difficult to reposition the feeder, since the hook must be removed from the soffit and fastened in a different position. In most cases, this requires the use of a tall ladder, and a number of tools to drill a hole and fasten the hook. This also leaves holes in the soffit when the hook or eyebolt is removed.

The inventor herein has provided one apparatus for overcoming these problems, in the creation of a removable hanger disclosed in U.S. Pat. No. 5,181,683. The hanger of the '683 patent permitted hanging of pots and bird feeders from the gutter of a roof.

While the hanger of the '683 patent permits simple removal and adjustment of the hook along the gutter, a gutter is not always located in a convenient position for hanging a plant or bird feeder.

Lattice is a common form of barrier which is utilized extensively in gardens and around homes. While it would be convenient and desirable to hang plants or bird feeders from lattice, no hangers are known to exist which provide simple and removable support on such a lattice. Rather, the consumer must rely on eyebolts screwed directly into the lattice to provide support for the desired objects.

SUMMARY OF THE INVENTION

It is therefore a general object of the present invention to provide an improved hanger for lattice.

Another object is to provide a hanger which may be removably connected to lattice.

Still another object of the present invention is to provide a removable hanger for lattice which may be securely attached to the lattice, yet be easily moved to different positions on the lattice.

These and other objects of the present invention will be apparent to those skilled in the art.

The hanger of the present invention includes a bracket with forward and rearward panels, and a connecting panel connecting the upper ends of the forward and rearward panels, to support the bracket on a lattice. The connecting panel of the bracket has a generally V-shaped lower surface which closely fits the upper surface of a strap intersection on the lattice, formed by the upper longitudinal edges of a pair of forward and rearward straps. A support arm mounted on the forward panel includes a horizontal arm projecting forwardly therefrom with a hook for suspending an object from the lattice. In one embodiment of the invention, a rod is mounted on the rearward panel and extends upwardly therefrom to engage a second strap intersection above the strap intersection upon which the bracket is mounted. In a second embodiment of the invention, the bracket is locked in position on the strap intersection by connecting the lower ends of the forward and rearward panels below the strap intersection.

DESCRIPTION OF THE PREFERRED EMBODIMENT

Figure 1:
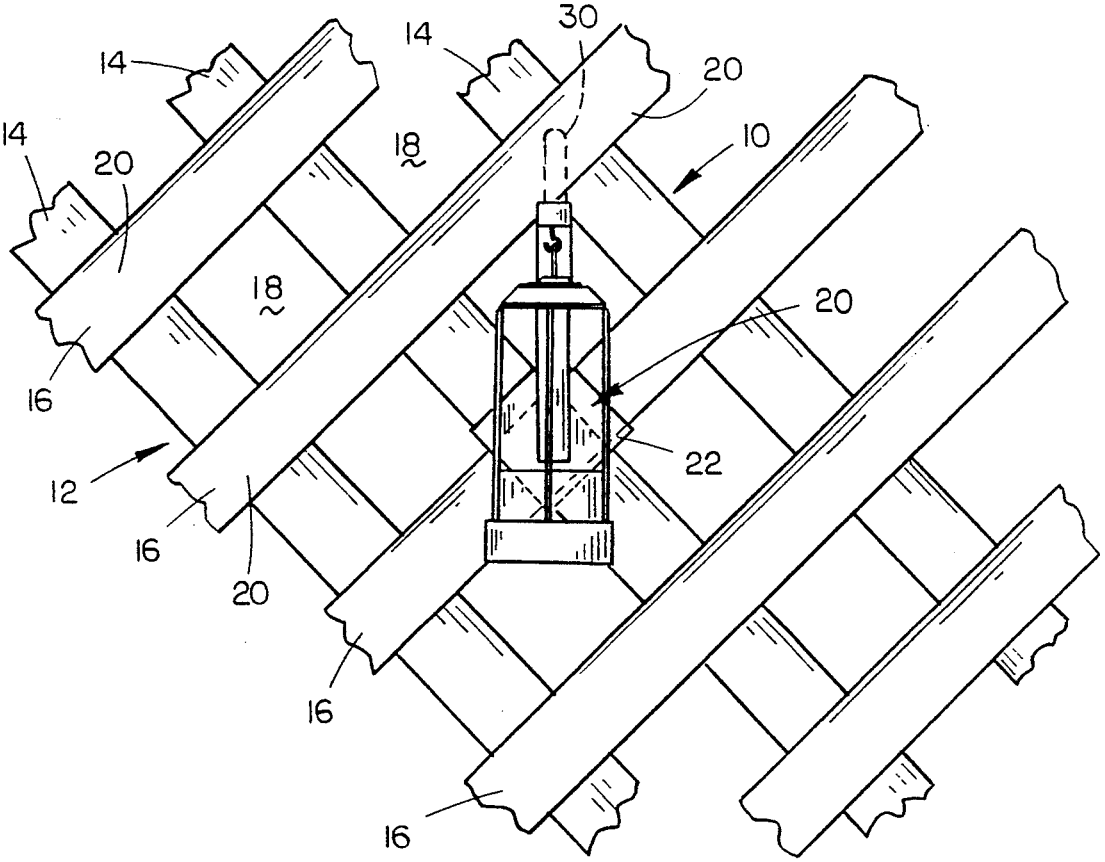
FIG. 1 is a front elevational view of the hanger of the present invention installed on lattice with a bird feeder hung thereon.

Referring now to the drawings, in which similar or corresponding parts are identified with the same reference numeral, and more particularly to FIG. 1, the hanger of the present invention as designated generally at 10, and is shown attached to a lattice 12.

Lattice 12, generally consists of a first plurality of parallel straps 14 attached to a second plurality of parallel straps 16, with apertures 18 formed between the crossed intersections 20.

Figure 2:
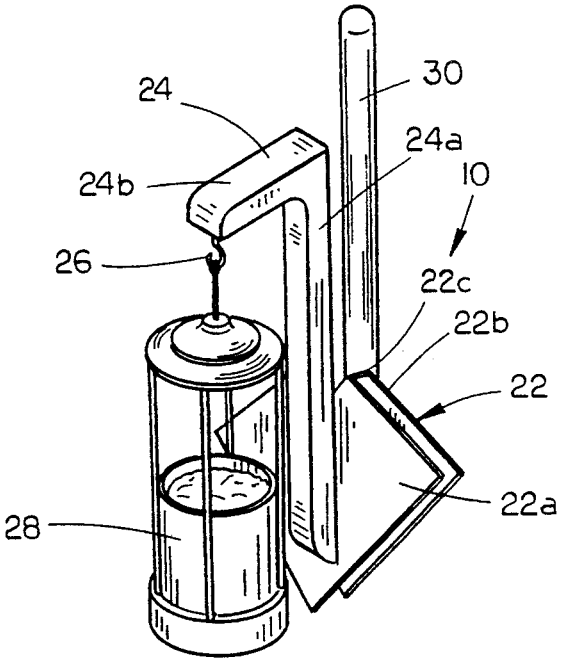
FIG. 2 is a perspective view of the invention with a bird feeder supported thereon.

Referring now to FIG. 2, hanger 10 includes a bracket 22 designed to slide over and engage a lattice intersection 20. Bracket 22 includes a front panel **22*a*, a rearward panel 22*b* and a top connecting panel 22*c*. An inverted L-shaped support arm 24 has a vertical leg 24*a* affixed to front panel 22*a* of bracket 22, and extends vertically upwardly therefrom. A horizontal leg 24*b* projects outwardly from the upper end of vertical leg 24*a* and has a hook 26 mounted therein for supporting an object, such as bird feeder 28**.

An elongated rod 30 is mounted to rearward panel **22*b* of bracket 22 and projects vertically upwardly therefrom, generally parallel with the vertical leg 24*a* of support arm 24. As shown in FIG. 1, rod 30 projects upwardly behind a lattice intersection 20 located above the intersection upon which bracket 22** is mounted.

Figure 3:
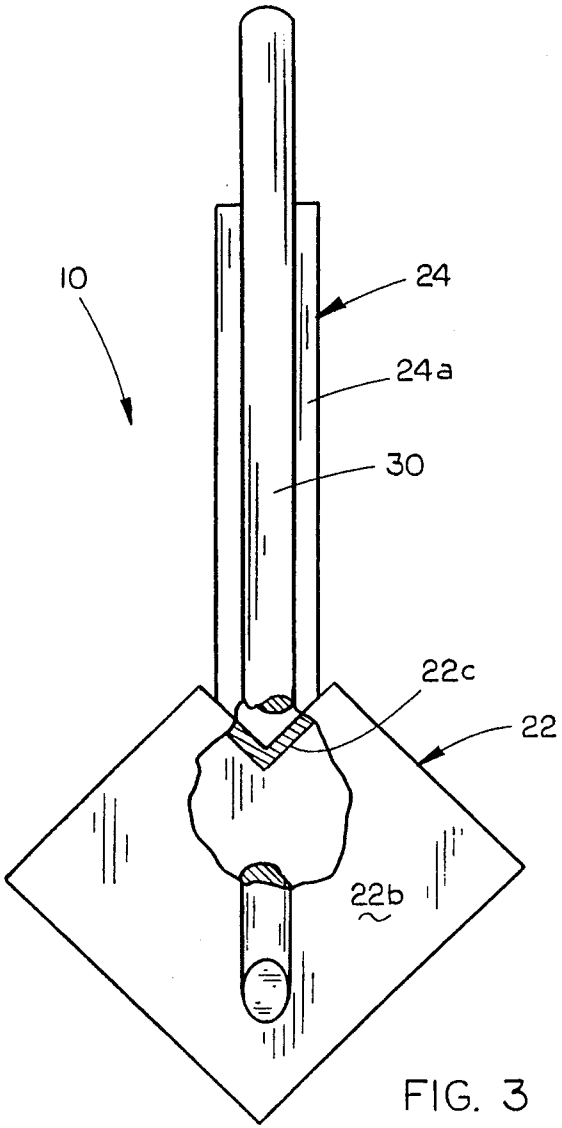
FIG. 3 is a rear elevational view of the invention.

Referring now to FIG. 3, a portion of rearward panel 22 is broken away to show top connecting panel **22*c* in more detail. Top panel 22*c* is generally V-shaped, with the angle of the legs of the V substantially the same as the angle at which the straps 14 and 16 cross in lattice 12 (as shown in FIG. 1). In this way, top panel 22*c* will snugly rest at the juncture of a strap 14 and a strap 16**.

Figure 4:
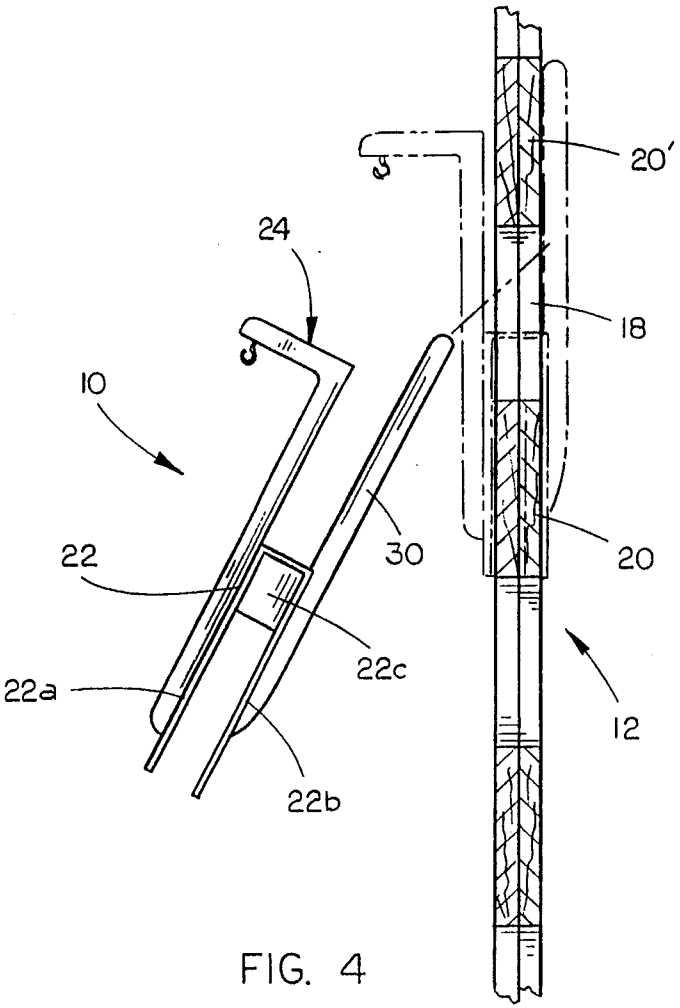
FIG. 4 is a side elevational view of the invention being installed on lattice.

Referring now to FIG. 4, hanger 10 is installed on lattice 12 by inserting the upper end of rod 30 through an opening 18 located directly above the lattice intersection 20 upon which it is desired to position the hanger. Hanger 10 is moved upwardly with rod 30 located behind the lattice 12 and support arm 24 located forwardly of lattice 12, as shown in broken lines in FIG. 4, until the lower end of panels **22*a* and 22*b* of bracket 22 clear the upper edge of the designated intersection 20. Hanger 10 is then lowered such that V-shaped top panel 22*c* rests in the V-shaped juncture of intersection 20. It should be noted that rod 30 extends upwardly a distance great enough to contact the next adjacent intersection 20' located above the intersection 20 upon which bracket 22 is positioned. In this way, the outward force caused by the weight of an object hanging on support arm 24 will be counteracted by rod 30 against intersection 20'**.

Figure 6:
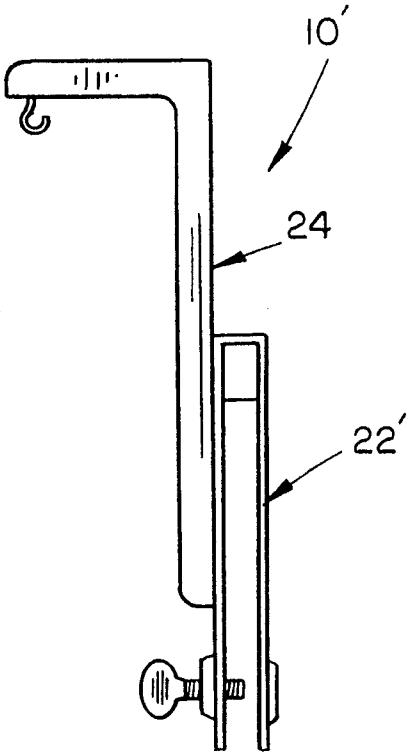
FIG. 6 is a side elevational view of the embodiment of FIG. 5.
Figure 5:
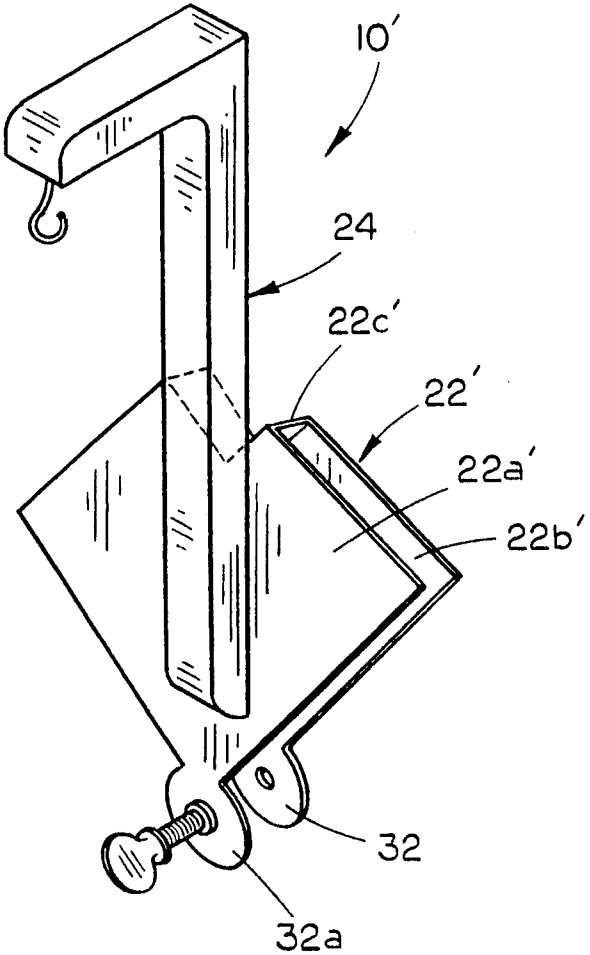
FIG. 5 is a perspective view of a second embodiment of the invention.

Referring now to FIGS. 5 and 6, a second embodiment of the hanger of the present invention is designated generally at 10' and includes a modified bracket 22' with the same support arm 24 of the first embodiment.

Bracket 22' includes front and rearward panels **22*a'* and 22*b'*, with a generally V-shaped top connecting panel 22*c'*, similar to the first embodiment of the invention. The main difference lies in the addition of a depending flange 32 on front panel 22*a'* and a corresponding depending flange 34 on rearward panel 22*b'***.

As shown in FIG. 5, flanges 32 and 34 depend from the lower end of panels **22*a'* and 22*b'*. Flange 32 has an aperture formed therein through which a threaded screw 36 is journaled. Flange 34 includes a threaded aperture 38 into which screw 36 may be threaded. In this way, brackets 22'** may be locked into position on lattice, to prevent inadvertent removal.

Figure 7:
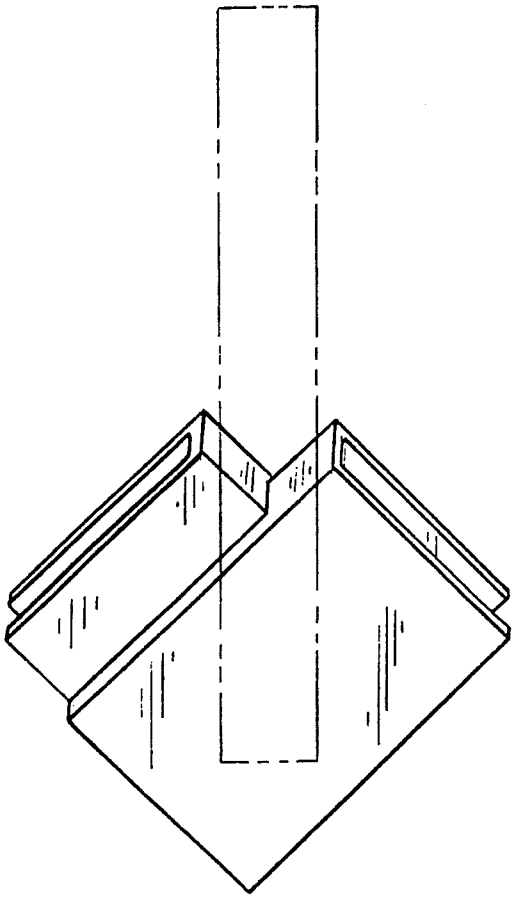
FIG. 7 is a forward perspective view of a third embodiment of the bracket of the invention.

Referring now to FIG. 7, a third embodiment of the invention is designated generally at 10'', and utilizes a modified bracket 22''.

Bracket 22'' includes a front plate **22*a''* which more closely follows the configuration of the straps of the lattice. Similarly, rearward plate 22*b''* follows the rearward configuration of the lattice. Top connecting plate 22*c''* still retains the general V-shape to fit the V-shape of the crossed straps of the lattice. It can be seen that bracket 22''** will more closely fit the straps of the lattice and thereby provide a more secure hold.

Whereas the invention has been shown and described in connection with the preferred embodiments thereof, it will be understood that many modifications, substitutions and additions may be made which are within the intended broad scope of the appended claims.

I claim:

1. A hanger for removable engagement on a lattice, comprising:

a bracket having a forward panel, a rearward panel, and an upper connecting panel connecting upper ends of the forward and rearward panels;

said forward and rearward panels being generally parallel to receive a portion of the lattice therebetween;

said connecting panel having a generally V-shaped lower surface formed of a pair of sloped leg surfaces connected along a single, common edge;

said connecting panel common edge oriented perpendicularly to the forward and rearward panels such that the sloped leg surfaces closely fit an intersection of straps on the lattice; and support means connected to the forward panel, to suspend an object from the lattice.

2. A hanger for removable engagement on a lattice, comprising:

a bracket having a forward panel, a rearward panel, and an upper connecting panel connecting upper ends of the forward and rearward panels;

said forward and rearward panels being generally parallel to receive a portion of the lattice therebetween;

said connecting panel having a generally V-shaped lower surface with a pair of sloped leg surfaces connected along an edge;

said connecting panel edge oriented perpendicularly to the forward and rearward panels such that the sloped leg surfaces closely fit an intersection of straps on the lattice;

support means connected to the forward panel, to suspend an object from the lattice; and a rod having upper and lower ends, said rod connected at the lower end to said rearward panel and projecting upwardly therefrom beyond the upper end of the rearward panel.

3. A hanger for removable engagement on a lattice, comprising:

a bracket having a forward panel, a rearward panel, and an upper connecting panel connecting upper ends of the forward and rearward panels;

said forward and rearward panels being generally parallel to receive a portion of the lattice therebetween;

said connecting panel having a generally V-shaped lower surface with a pair of sloped leg surfaces connected along an edge;

said connecting panel edge oriented perpendicularly to the forward and rearward panels such that the sloped left surfaces closely fit an intersection of straps on the lattice; and support means connected to the forward panel, to suspend an object from the lattice;

said support means including:

a support arm with a horizontal leg mounted to an upper end of a vertical leg;

a lower end of the vertical leg being mounted to said forward panel such that the horizontal leg projects forwardly; and attachment means on the horizontal leg for removably suspending an object therefrom.

4. The hanger of claim 1, wherein said forward and rearward panels include downwardly projecting free lower ends, and further comprising means for selectively connecting the lower ends of said forward and rearward panels.

5. In combination:

a lattice, comprising a plurality of generally parallel and spaced apart coplanar forward straps, and a plurality of generally parallel and spaced apart coplanar rearward straps mounted in a transverse orientation on said forward straps to form a structure of crossed straps, having a plurality of uniformly spaced apart strap intersections and lattice openings;

said strap intersection upper surface being formed of an upper longitudinal edge of a forward strap and an upper longitudinal edge of a rearward strap, to form a generally V-shaped upper surface;

a hanger removably mounted on a strap intersection, having means thereon for suspending an object from the lattice;

said hanger including a bracket having a forward panel, a rearward panel, and an upper connecting panel connecting upper ends of the forward and rearward panels;

said connecting panel having a lower surface engaging an upper surface of a strap intersection to support said bracket on the lattice;

said connecting panel lower surface being generally V-shaped to flushly engage the strap intersection upper surface.

6. The combination of claim 5, wherein said forward and rearward panels include is downwardly projecting free lower ends, and further comprising means for selectively connecting the lower ends of said forward and rearward panels to selectively secure a strap intersection between said forward and rearward panels.

7. The combination of claim 5, wherein said forward and rearward straps have forward and rearward surfaces;

wherein said bracket forward panel includes a first portion flushly engaging a portion of the forward surface of the forward strap, a second portion flushly engaging a portion of the upper longitudinal edge of the forward strap, and a third portion flushly engaging a portion of the forward surface of the rearward strap; and wherein the rearward panel includes a first portion flushly engaging a portion of the rearward surface of the rearward strap, a second portion flushly engaging a portion of the upper longitudinal edge of the rearward strap, and a third portion flushly engaging a portion of the rearward surface of the forward strap.

8. In combination:

a lattice, comprising a plurality of generally parallel and spaced apart coplanar forward straps, and a plurality of generally parallel and spaced apart coplanar rearward straps mounted in a transverse orientation on said forward straps to form a structure of crossed straps, having a plurality of uniformly spaced apart strap intersections and lattice openings; and a hanger removably mounted on a strap intersection, having means thereon for suspending an object from the lattice;

said hanger including a bracket having a forward panel, a rearward panel, and an upper connecting panel connecting upper ends of the forward and rearward panels;

said connecting panel having a V-shaped lower surface engaging an upper surface of a strap intersection to support said bracket on the lattice;

said means for suspending an object from the lattice including a support arm with a horizontal leg mounted to an upper end of a vertical leg, a lower end of the vertical leg being mounted to said forward panel such that the horizontal leg projects forwardly; and attachment means on the horizontal leg for removably suspending an object therefrom.

9. In combination:

a lattice, comprising a plurality ,of generally parallel and spaced apart coplanar forward straps, and a plurality of generally parallel and spaced apart coplanar rearward straps mounted in a transverse orientation on said forward straps to form a structure of crossed straps, having a plurality of uniformly spaced apart strap intersections and lattice openings; and a hanger removably mounted on a strap intersection, having means thereon for suspending an object from the lattice;

said hanger including a bracket having a forward panel, a rearward panel, and an upper connecting panel connecting upper ends of the forward and rearward panels;

said connecting panel having a V-shaped lower surface engaging an upper surface of a strap intersection to support said bracket on the lattice;

said hanger further comprising a rod having upper and lower ends;

said rod connected at the lower end to said rearward panel and projecting upwardly therefrom a distance sufficient to extend the rod upper end adjacent a second strap intersection in said lattice, above the strap intersection upon which the bracket is supported.

* * * * *